US010667667B2

(12) United States Patent
Kim et al.

(10) Patent No.: US 10,667,667 B2
(45) Date of Patent: Jun. 2, 2020

(54) DISHWASHER

(71) Applicant: LG ELECTRONICS INC., Seoul (KR)

(72) Inventors: Seunghun Kim, Seoul (KR); Sangwoo Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 15/737,950

(22) PCT Filed: Jul. 18, 2016

(86) PCT No.: PCT/KR2016/007777
§ 371 (c)(1),
(2) Date: Dec. 19, 2017

(87) PCT Pub. No.: WO2017/022974
PCT Pub. Date: Feb. 9, 2017

(65) Prior Publication Data

US 2018/0110397 A1 Apr. 26, 2018

(30) Foreign Application Priority Data

Aug. 4, 2015 (KR) ..... 10-2015-0109942

(51) Int. Cl.
*A47L 15/42* (2006.01)

(52) U.S. Cl.
CPC ..... *A47L 15/4234* (2013.01); *A47L 15/4278* (2013.01); *A47L 15/4214* (2013.01); *A47L 15/4257* (2013.01)

(58) Field of Classification Search
CPC ..... A47L 15/4278; A47L 15/4234; A47L 15/4214; A47L 15/4257
See application file for complete search history.

(56) References Cited

U.S. PATENT DOCUMENTS

2007/0102025 A1 5/2007 Ahn et al.
2007/0235063 A1* 10/2007 Lee ..... A47L 15/0015 134/25.2

(Continued)

FOREIGN PATENT DOCUMENTS

CN 203303009 11/2013
DE 10-2007-056707 5/2009

(Continued)

OTHER PUBLICATIONS

European Search Report dated Jan. 11, 2019 issued in EP Application No. 16833210.4.

(Continued)

*Primary Examiner* — Benjamin L Osterhout
(74) *Attorney, Agent, or Firm* — Ked & Associates, LLP

(57) ABSTRACT

A dishwasher (100) is disclosed. The dishwasher (100) includes a cabinet (1) having an opening (11), a tub (2) provided in the cabinet (1) for receiving objects to be washed, a spray arm (711, 713) for spraying wash water to the objects, a sump (3) for storing wash water, a pump (8) for supplying the wash water stored in the sump (3) to the spray arm (711, 713), a door (13) for opening and closing the opening (11), a first steam nozzle (42) provided in the tub (2), a docking unit (62) provided at the door (13) and connected to the first steam nozzle (42) for supplying steam to the first steam nozzle (42), and a docking connector (64) provided at the tub (2) and is connected to a steam source for supplying steam to the docking unit (62), wherein, when the door (13) is opened, the docking unit (62) is disconnected from the docking connector (64), and, when the door (139 is closed, the docking unit (62) is connected to the docking connector (64) to define a closed path along which steam flows.

13 Claims, 13 Drawing Sheets

(56) References Cited

U.S. PATENT DOCUMENTS

| | | | | |
|---|---|---|---|---|
| 2009/0007941 | A1 | 1/2009 | Kim et al. | |
| 2009/0126766 | A1 | 5/2009 | Ahn et al. | |
| 2009/0126768 | A1* | 5/2009 | Woo | A47L 15/0002 134/56 D |
| 2015/0265133 | A1* | 9/2015 | Choi | A47L 15/4217 134/105 |
| 2016/0029871 | A1* | 2/2016 | Kim | A47L 15/4259 134/184 |

FOREIGN PATENT DOCUMENTS

| | | |
|---|---|---|
| EP | 1 800 589 | 6/2007 |
| JP | 2003-265394 | 9/2003 |
| KR | 10-2006-0124273 | 12/2006 |
| KR | 10-2010-0109300 | 10/2010 |
| KR | 10-2012-0116325 | 10/2012 |
| WO | WO 2008/147035 | 12/2008 |

OTHER PUBLICATIONS

International Search Report dated Oct. 31, 2016 issued in Application No. PCT/KR2016/007777.

* cited by examiner

[Fig. 4]
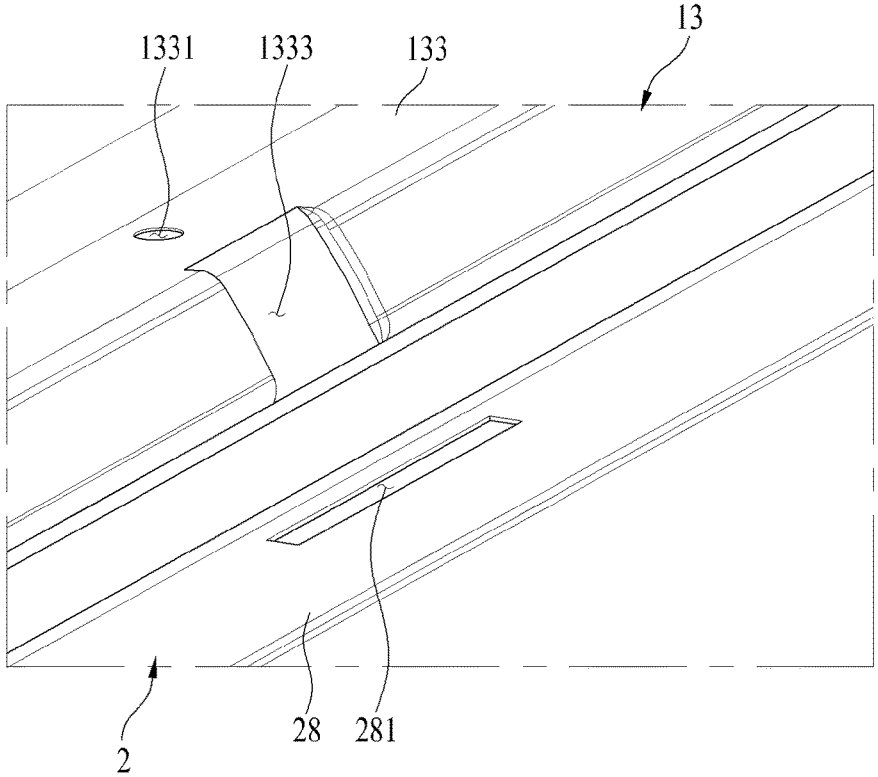
[Fig. 5]
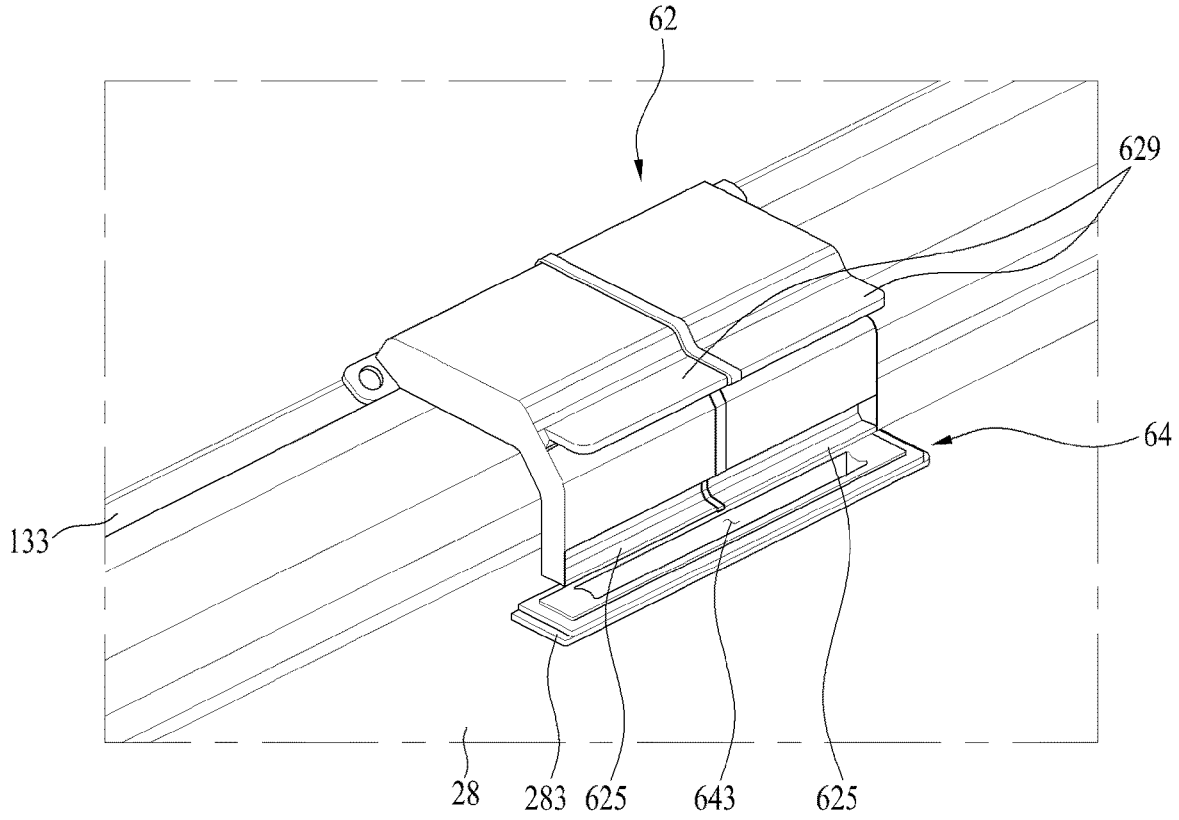

[Fig. 6]
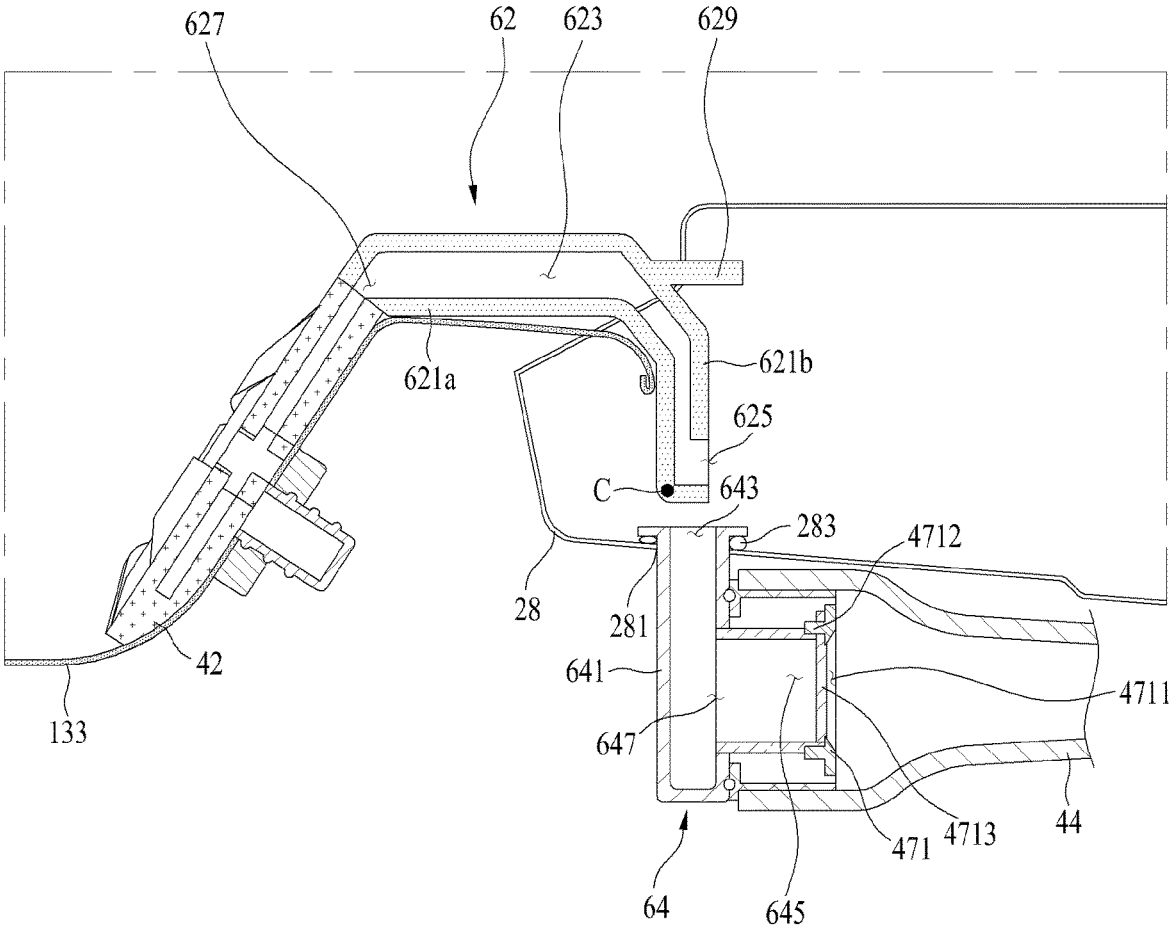

[Fig. 7]
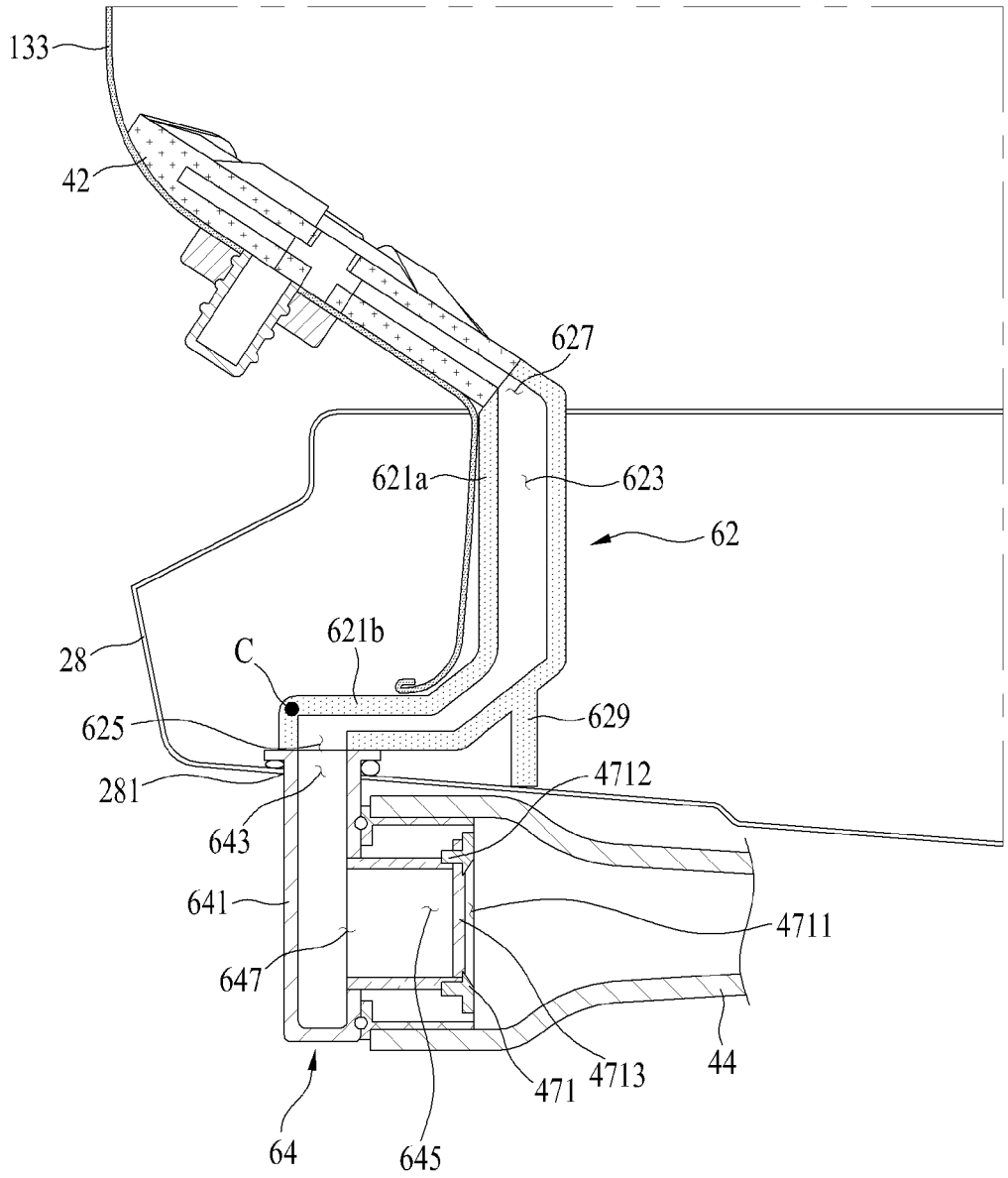

[Fig. 8]
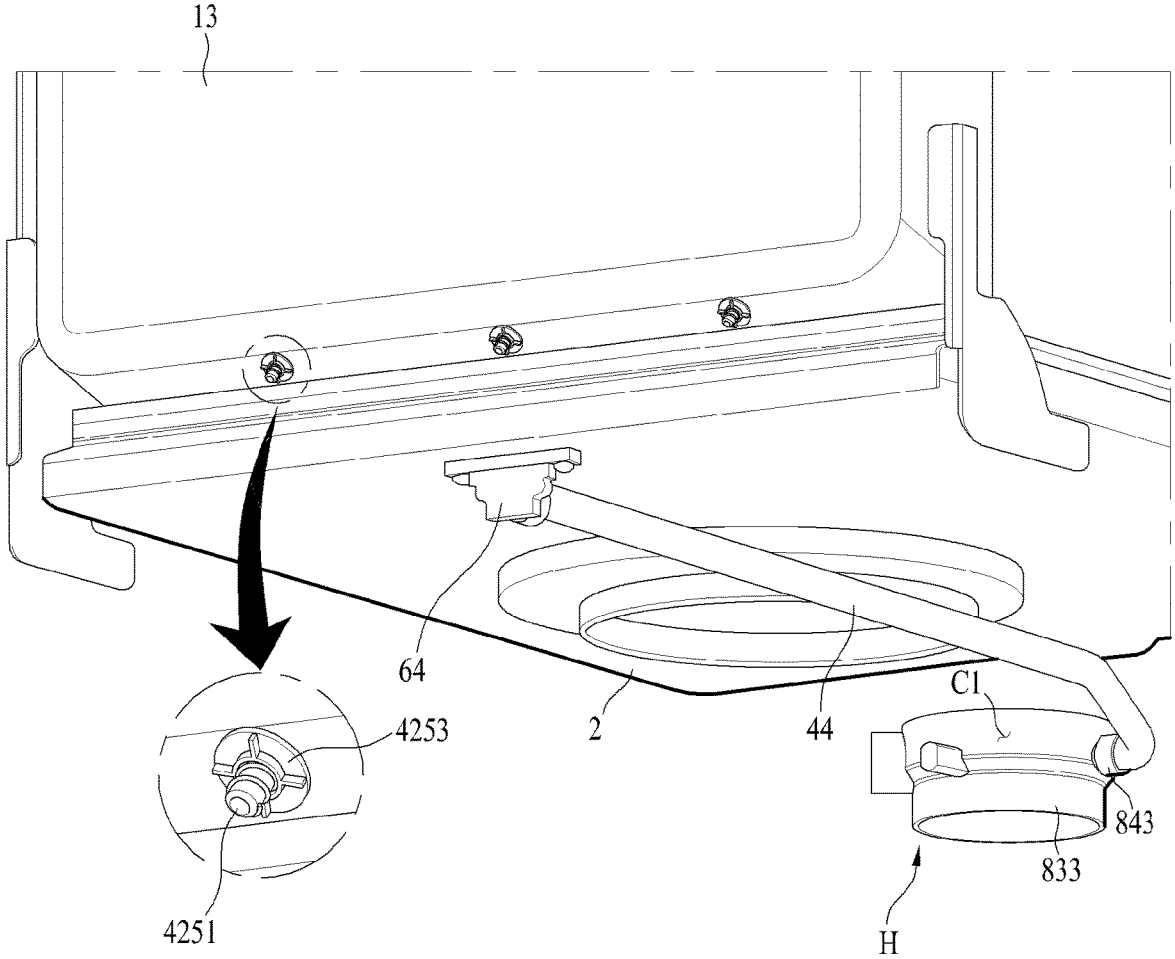

[Fig. 9]
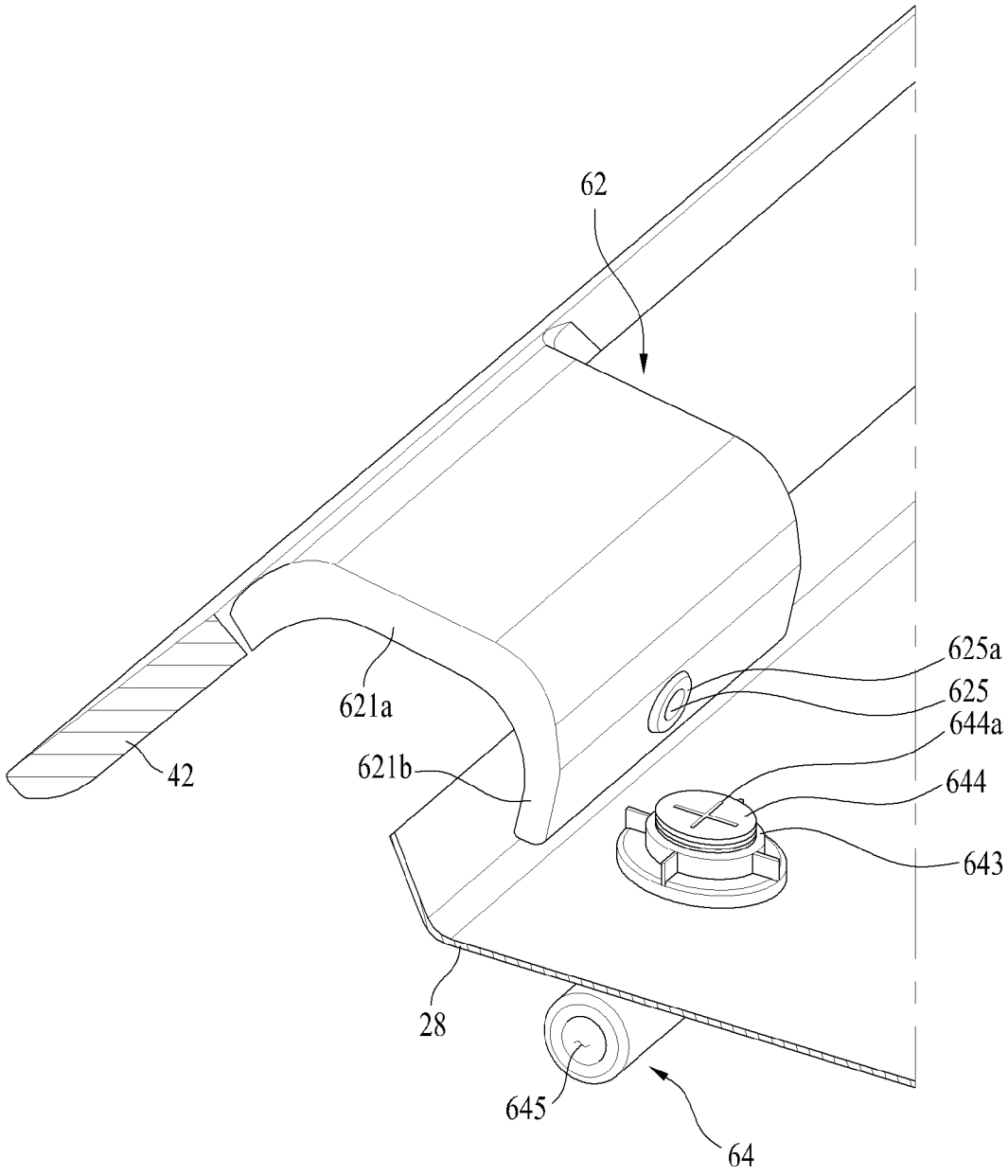

[Fig. 10]
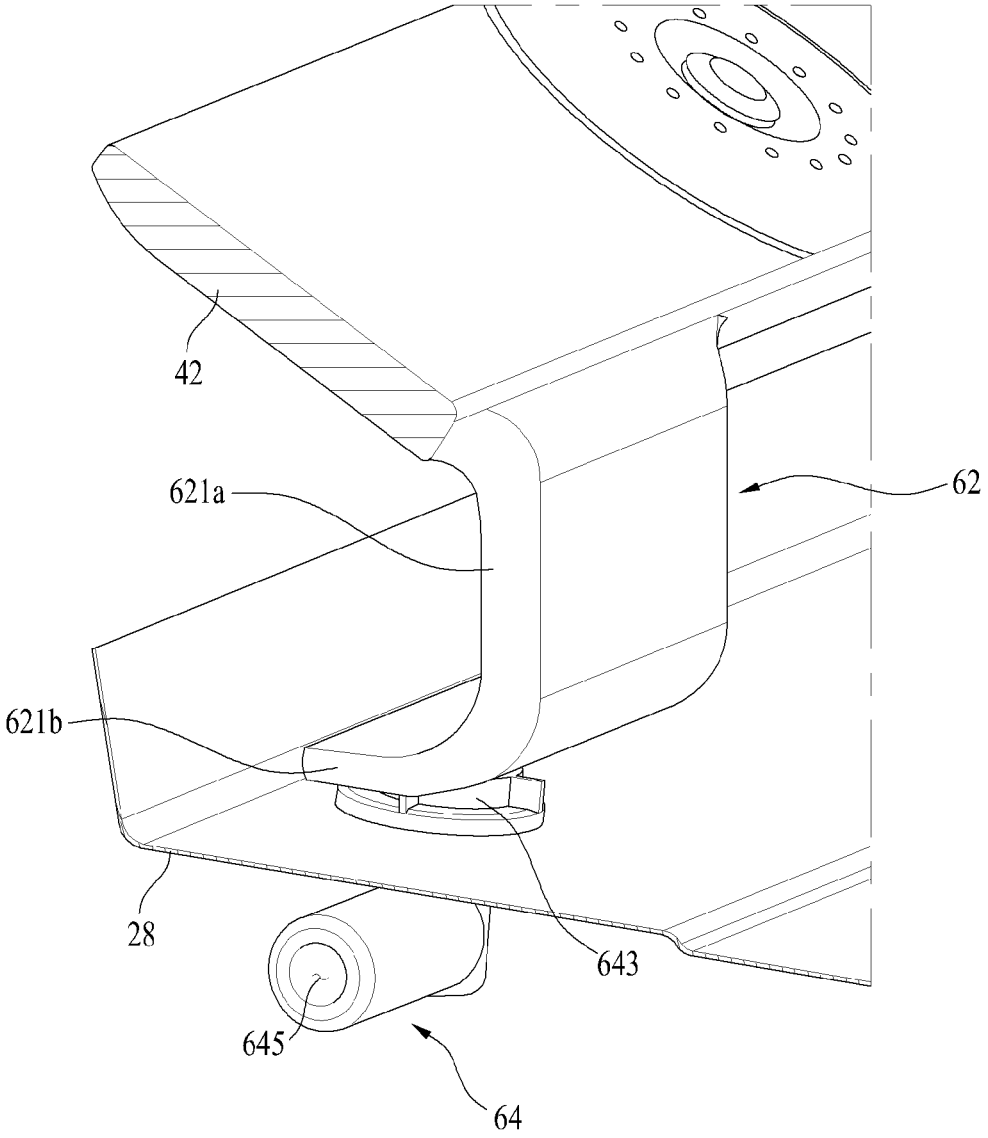

[Fig. 11]
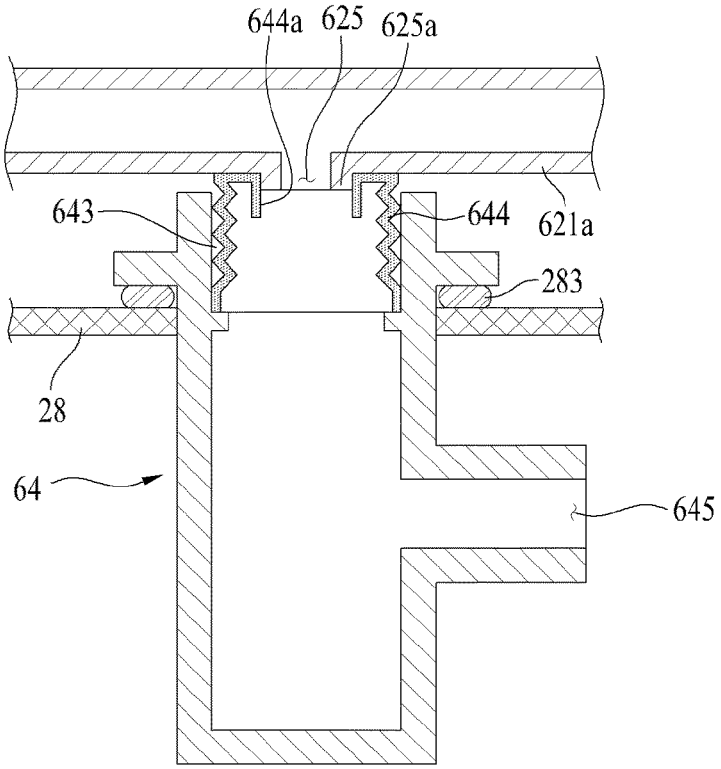
[Fig. 12]
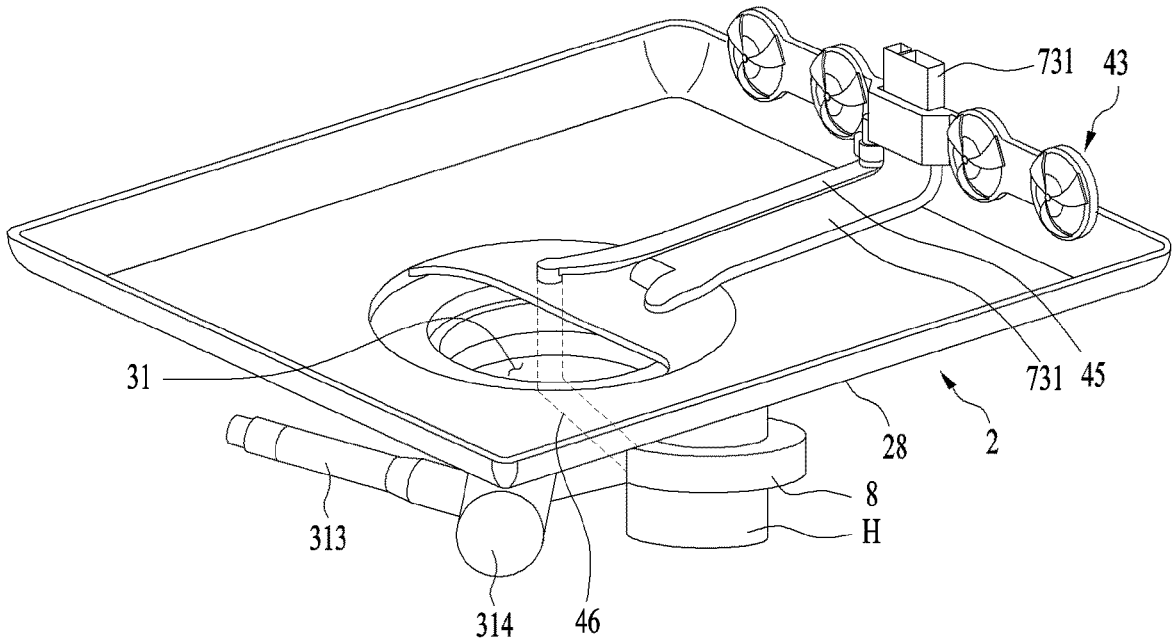

[Fig. 13]
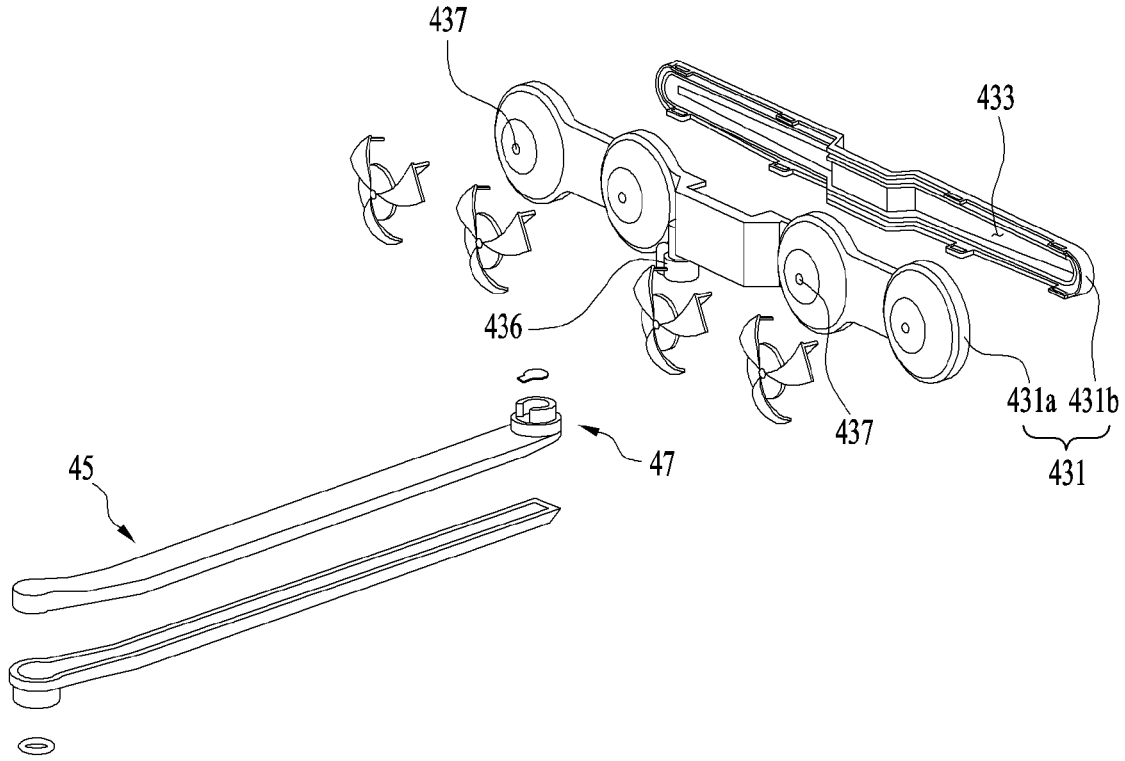

[Fig. 15]
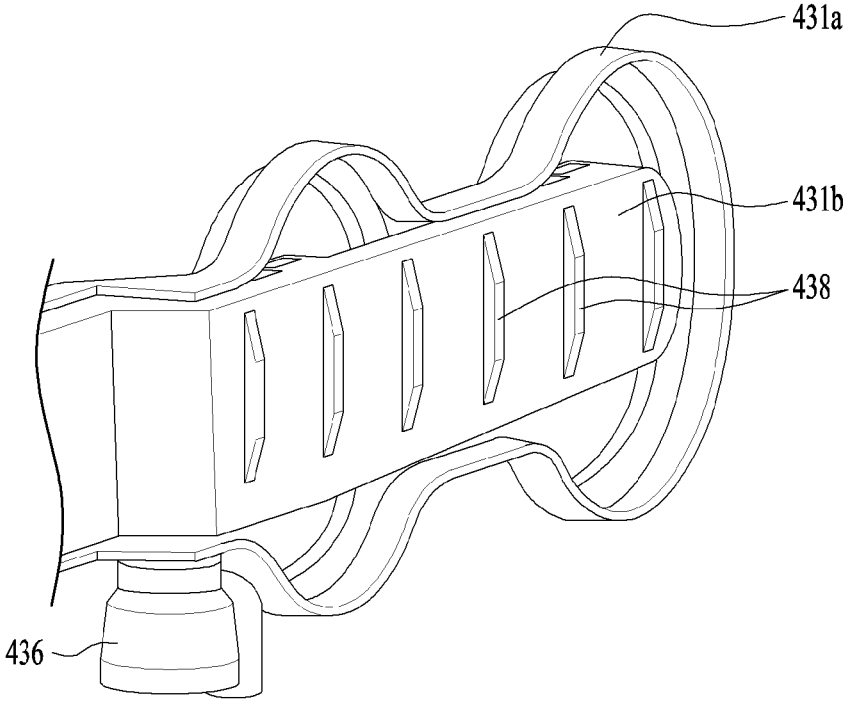
[Fig. 16]
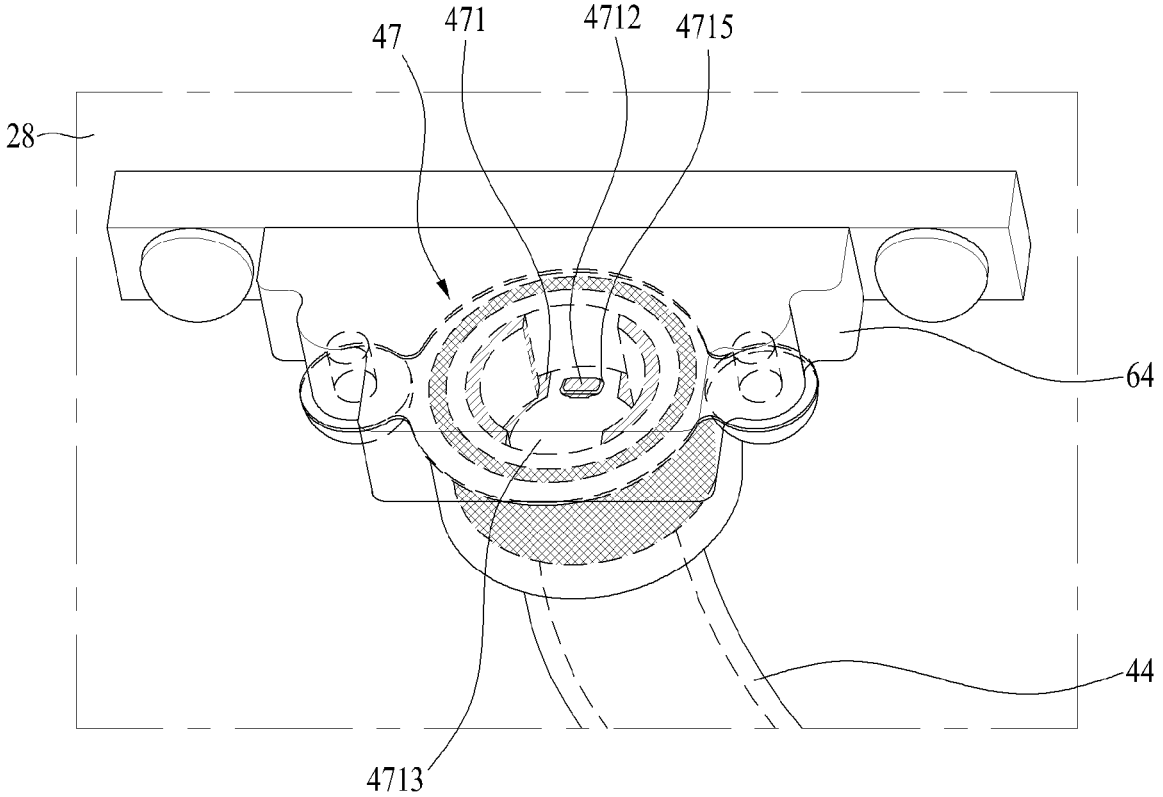

[Fig. 17]
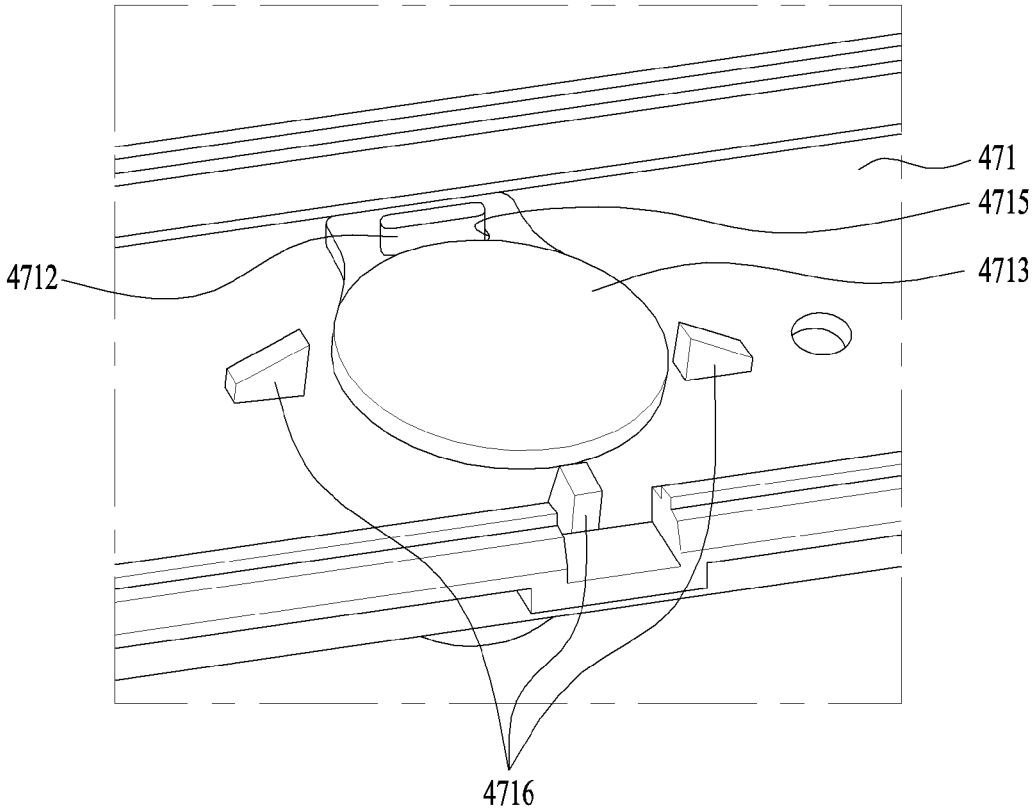
[Fig. 18]
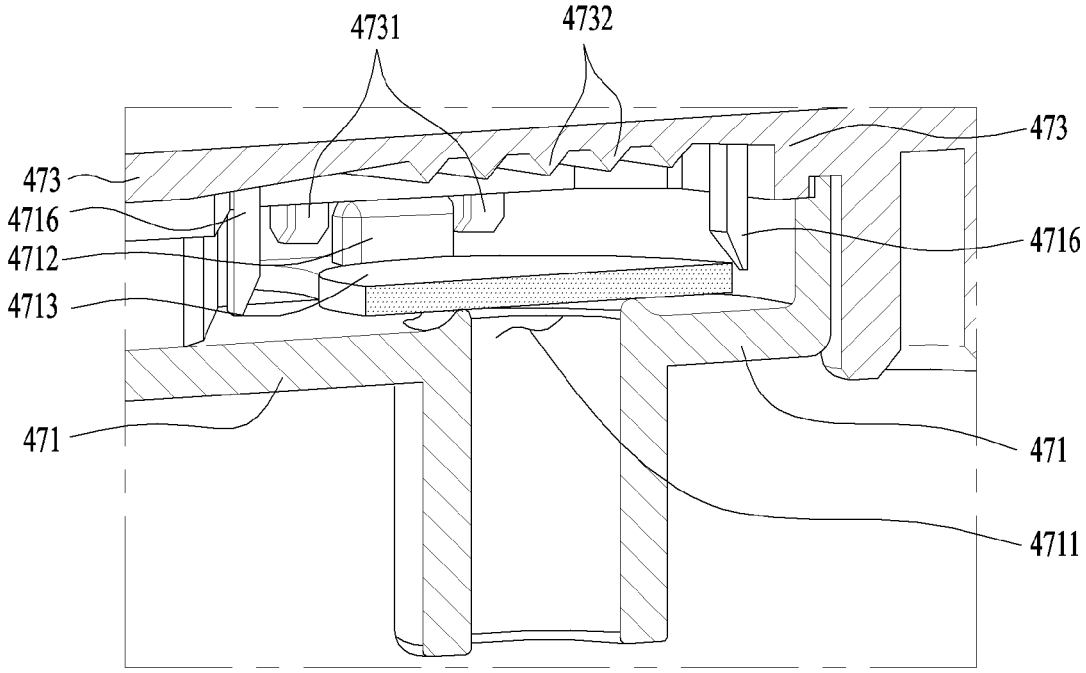

DISHWASHER

CROSS-REFERENCE TO RELATED PATENT APPLICATIONS

This application is a U.S. National Stage Application under 35 U.S.C. § 371 of PCT Application No. PCT/KR2016/007777, filed Jul. 18, 2016, which claims priority to Korean Patent Application No. 10-2015-0109942, filed Aug. 4, 2015, whose entire disclosures are hereby incorporated by reference.

TECHNICAL FIELD

The present invention relates to a dishwasher and more particularly to a steam path for supplying steam to a steam nozzle provided in a tub.

BACKGROUND ART

A dishwasher is an electric home appliance machine that sprays wash water onto objects to be washed in order to remove foreign matter from the objects. A conventional dishwasher generally includes a tub that defines a washing space, a rack provided in the tub for receiving objects to be washed, a spray arm for spraying wash water to the rack, a sump for storing wash water, and a pump for supplying the wash water stored in the sump to the spray arm.

Meanwhile, some examples of the conventional dishwasher are configured to wash objects to be washed using heated wash water or to supply steam to objects to be washed in order to wash or sterilize the objects. In the conventional dishwasher, the wash water stored in the sump is heated using a heater provided in the sump. In some examples, the conventional dishwasher further includes a steam generator for generating steam.

The conventional dishwasher further includes a steam nozzle provided at the side of the tub for spraying steam into the tub and a steam hose connected between the steam nozzle and the steam generator. In this case, however, the steam sprayed from the side of the tub cannot wet all surfaces of the objects.

In order to solve this problem, another steam nozzle may be provided at the door so as to spray steam to the objects. In this case, however, a steam path may move as the result of movement of the steam nozzle when the door is opened and closed.

If the steam path moves repeatedly due to the repeated opening and closing of the door, a hose defining the steam path may tear, and water may leak from the connection between the steam nozzle and the hose. In addition, in the case in which the steam path is provided in the tub, the steam path may be corroded by heated wash water and foreign matter. Furthermore, the steam path may disturb the movement of a washing arm.

DISCLOSURE

Technical Problem

An object of the present invention devised to solve the problem lies on a dishwasher including a steam path for supplying steam to a steam nozzle provided at a door. Another object of the present invention devised to solve the problem lies on a dishwasher including a steam path configured to be prevented from tearing even when a door is repeatedly opened and closed.

A further object of the present invention devised to solve the problem lies on a dishwasher configured such that a steam path is defined as a closed path so as to supply steam to a steam nozzle in the state in which a door is closed and the steam path is defined as an open path in the state in which a door is open.

Technical Solution

The object of the present invention can be achieved by providing a dishwasher including s a cabinet having an opening, a tub provided in the cabinet for receiving objects to be washed, a spray arm for spraying wash water to the objects, a sump for storing wash water, a pump for supplying the wash water stored in the sump to the spray arm, a door for opening and closing the opening, a first steam nozzle provided in the tub, a docking unit provided at the door and connected to the first steam nozzle for supplying steam to the first steam nozzle, and a docking connector provided at the tub and is connected to a steam source for supplying steam to the docking unit, wherein, when the door is opened, the docking unit is disconnected from the docking connector, and, when the door is closed, the docking unit is connected to the docking connector to define a closed path along which steam flows.

The docking unit and the docking connector may be disconnected from each other in the tub. The docking connector may include a connector body, a connector path defined in the connector body, the connector path constituting a steam path, a connector outlet port provided at one end of the connector path and connected to the docking unit for defining a closed path, and a connector inlet port provided at the other end of the connector path. The connector inlet port may be provided outside the tub.

The dishwasher may further include a first steam path connected between the connector inlet port and the steam source, wherein the steam source may include one selected from among an additional steam generator, a sump heater, provided in the sump, and a pump heater, provided in the pump. The docking connector may further include a check valve provided in the connector inlet port for preventing external air from being introduced into the first steam nozzle. The connector outlet port may be provided in the bottom of the tub.

The docking connector may further include a connector gasket provided between the docking unit and the connector outlet port for forming a seal between the docking unit and the connector outlet port when the connector outlet port is connected to the docking unit. The connector gasket may be provided at the upper surface thereof with a cross-shaped incision part, and the docking unit may include a docking unit protrusion protruding so as to be inserted through the incision part.

The first steam nozzle may be provided at the inside of the door. The first steam nozzle and the docking unit may be fixed to the door, and may communicate with each other to define a steam path. The docking unit may include a first body connected to the first steam nozzle, a second body connected to the front of the first body at a predetermined angle, and a docking unit path defined in the first body and the second body, and the second body may include a docking unit inlet port connected to the docking connector for supplying steam to the docking unit path.

When the door is closed, the docking unit inlet port may be connected to the docking connector, and, when the door is opened, the docking unit inlet port may be disconnected from the docking connector. A rotary shaft of the door may be provided adjacent to one side of the docking unit inlet port.

The dishwasher may further include an overhang protruding from the docking unit for preventing foreign matter from being introduced into a connector outlet port of the docking connector, open toward the tub, as the result of disconnection of the docking unit from the docking connector when the door is opened. The overhang may be provided parallel to the first body, and may be provided above the connector outlet port.

The check valve may include a first partition having a steam path hole, through which steam is discharged, a back pressure prevention plate for opening and closing the steam path hole, a prevention plate ring formed at one side of the back pressure prevention plate, and a fixing rib provided at the first partition so as to allow the prevention plate ring to be fitted thereonto for limiting the movement of the back pressure prevention plate. The check valve may further include separation prevention ribs provided spaced apart from the outer circumferential surface of the back pressure prevention plate for preventing the back pressure prevention plate from being separated in the leftward and rightward direction.

The check valve may further include stoppers provided above the back pressure prevention plate so as to be spaced apart from each other such that the stoppers collide with the back pressure prevention plate, moved by the pressure of steam, to provide restoring force. The check valve may further include a contact prevention rib formed on a second partition provided opposite to the steam path hole for preventing the back pressure prevention plate from clinging to the second partition due to a hydroplaning phenomenon.

Advantageous Effects

The present invention has the effect of providing a dishwasher including a steam path for supplying steam to a steam nozzle provided at a door. In addition, the present invention has the effect of providing a dishwasher including a steam path configured to be prevented from tearing even when a door is repeatedly opened and closed.

In addition, the present invention has the effect of providing a dishwasher configured such that a steam path is defined as a closed path so as to supply steam to a steam nozzle in the state in which a door is closed and the steam path is defined as an open path in the state in which the door is open.

DESCRIPTION OF DRAWINGS

The accompanying drawings, which are included to provide a further understanding of the invention, illustrate embodiments of the invention and together with the description serve to explain the principle of the invention.

In the drawings:

FIG. 4 is an exploded perspective view showing the rear panel of the door and the bottom of a tub in the dishwasher according to the present invention;

FIG. 5 is a view showing the state in which the door is open in the dishwasher according to the present invention;

FIG. 6 is a side sectional view of FIG. 5;

FIG. 7 is a side sectional view showing the state in which the door is closed in the dishwasher according to the present invention;

FIG. 8 is an exploded perspective view showing a docking connector and a first steam path provided in the dishwasher according to the present invention;

FIG. 9 is a view showing a connector gasket in the state in which the door is open in the dishwasher according to the present invention;

FIG. 10 is a view showing the connector gasket in the state in which the door is closed in the dishwasher according to the present invention;

FIG. 11 is a sectional view showing the connector gasket in the state in which the door is closed in the dishwasher according to the present invention;

FIG. 12 is a view showing a second steam nozzle provided at the rear of a tub provided in the dishwasher according to the present invention;

FIG. 13 is an exploded perspective view showing the second steam nozzle provided in the dishwasher according to the present invention;

FIG. 15 is a view showing foreign matter blocking ribs provided in the second steam nozzle of the present invention;

FIG. 16 is an exploded perspective view showing a back pressure prevention unit provided in the docking connector provided in the dishwasher according to the present invention; and FIGS. 17 and 18 are views showing the back pressure prevention unit of the present invention.

BEST MODE

Reference will now be made in detail to the preferred embodiments of the present invention, examples of which are illustrated in the accompanying drawings. All terms disclosed in this specification correspond to general terms understood by persons having ordinary skill in the art to which the present invention pertains unless the terms are specially defined. If the terms disclosed in this specification conflict with general terms, the terms may be understood on the basis of their meanings as used in this specification.

It should be noted herein that the construction and control method of a device which will hereinafter be described are given only for illustrative purposes, and that the protection scope of the invention is not limited thereto. Wherever possible, the same reference numbers will be used throughout the drawings to refer to the same or like parts.

Figure 1:
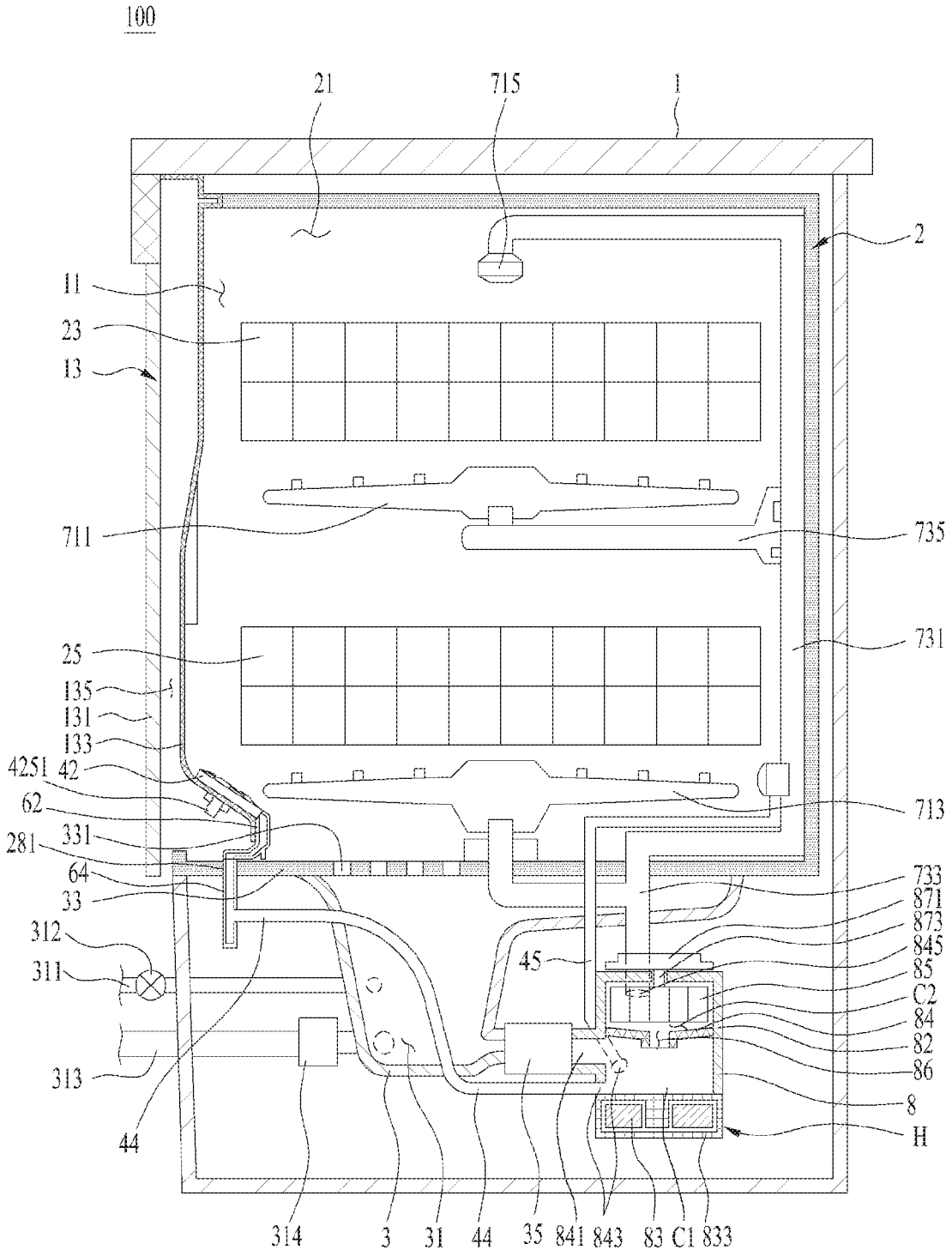
FIG. 1 is a view showing an example of a dishwasher according to the present invention.

The present invention relates to a dishwasher that is capable of spraying steam from the front or the rear of a tub. FIG. 1 is a view showing an example of a dishwasher according to the present invention.

As shown in FIG. 1, the dishwasher, denoted by reference numeral 100, may include a cabinet 1, a tub 2 provided in the cabinet 1 for receiving objects to be washed, spray arms 711 and 713 for spraying wash water to the objects, a sump 3 for storing wash water, and a door 13 for opening and closing an opening 11 formed in the cabinet 1.

The cabinet 1 defines the external appearance of the dishwasher. The opening 11 is formed in one side of the cabinet 1. The opening 11 communicates with the interior of the tub 2.

A washing space 21 is defined in the tub 2. Racks, in which the objects are received, may be provided in the washing space 21. The racks may include an upper rack 23 provided in the upper part of the tub 2 and a lower rack 25 provided below the upper rack 23. The tub 2 is opened and closed by the door 13, which is provided at one surface of the cabinet 1 such that a user opens the door 13 and withdraws the upper rack 23 and the lower rack 25 from the tub 2.

In the case in which the racks include the upper rack 23 and the lower rack 25, the spray arms 711 and 713 may include an upper arm 711 for spraying wash water to the upper rack 23 from under the upper rack 23, and a lower arm 713 for spraying wash water to the lower rack 25 from under the lower rack 25. In addition, a top arm 715 for spraying wash water to the upper rack 23 from above the upper rack 23 may be further provided.

The wash water sprayed to the objects by the spray arms 711 and 713 may be collected in the sump 3. The sump 3 includes a storage unit 31 provided under the tub 2 to store wash water. The storage unit 31 stores wash water containing foreign matter removed from the objects.

The sump 3 is provided at the top thereof with a sump cover 33, by which the sump 3 is partitioned from the tub 2. In this case, the sump cover 33 may be provided with a collection hole 331, through which the interior of the tub 2 communicates with the interior of the sump 3.

Meanwhile, the sump 3 is connected to a water source (not shown) through a water supply path 311. The water supply path 311 may be opened and closed by a water supply valve 312, which is controlled by a controller (not shown).

The wash water stored in the sump 3 is discharged out of the dishwasher through a drainage path 313 and a drainage pump 314. The water stored in the sump 3 is supplied to the spray arms 711 and 713 via a pump 8 and a first supply path 731, a description of which will follow. The first supply path 731 is connected between the pump 8 and the top arm 715. The first supply path 731 extends into the tub 2 through the bottom of the tub 2. In addition, the first supply path 731 extends to the top of the tub 2 along one side of the tub 2.

Meanwhile, the upper arm 711 is connected to a third supply path 735, which diverges from the first supply path 731. In addition, the upper arm 711 is rotatably coupled to one end of the third supply path 735. The lower arm 713 is rotatably provided. The lower arm 713 is connected to a second supply path 733, which extends through the bottom of the tub 2. The second supply path 733 is connected to the sump 3 or to a pump 8 such that wash water is supplied to the second supply path 733.

Meanwhile, the dishwasher 100 further includes a pump 8 for supplying the wash water stored in the sump 3 to the spray arms 711 and 713. The pump 8 may include a body 82 fixed in the cabinet 1, a sump partition 84 for partitioning the inner space of the body 82 into a first chamber C1 and a second chamber C2, a communication hole 86 formed through the sump partition 84 for allowing the first chamber C1 and the second chamber C2 to communicate with each other therethrough, an introduction part 841 connected between the sump 3 and the first chamber C1, a wash water discharge part 845 connected between the second chamber C2 and the first supply path 731, an impeller 85 provided in the second chamber C2, and a heater assembly H provided in the bottom of the first chamber C1.

The pump 8 is connected to the sump 3 through a connection path 35. The connection path 35 is connected to the lower end of the side of the storage unit 31 of the sump 3 and to the introduction part 841 of the pump 8.

Since the heater assembly H defines the bottom of the first chamber C1, the pump 8 may simultaneously perform a function of heating wash water and a function of circulating wash water. The heater assembly H may include a pump heater 83, which is exposed in the first chamber C1 such that the pump heater 83 directly contacts wash water. Alternatively, the heater assembly H may include a pump heater 83, which is provided in a heater housing 833. The heater housing 833 may define the bottom of the first chamber C1 such that the pump heater 83 does not directly contact wash water. Heat may be transferred to the heater housing 833 such that wash water is heated by the heater housing 833. In this case, the heater housing 833 may be made of a conductor, such as a metal, such that thermal energy can be effectively transferred to the wash water.

The impeller 85 moves wash water, introduced from the first chamber C1 into the second chamber C2 through the communication hole 86, to the wash water discharge part 845. The impeller 85 may be rotated by an impeller drive unit 87 provided outside the body 82. The drive unit 87 may include a motor 871 provided at the top of the second chamber C2 and a rotary shaft 873 of the motor 871*m* which is connected to the impeller 85 through the pump 8.

Figure 2:
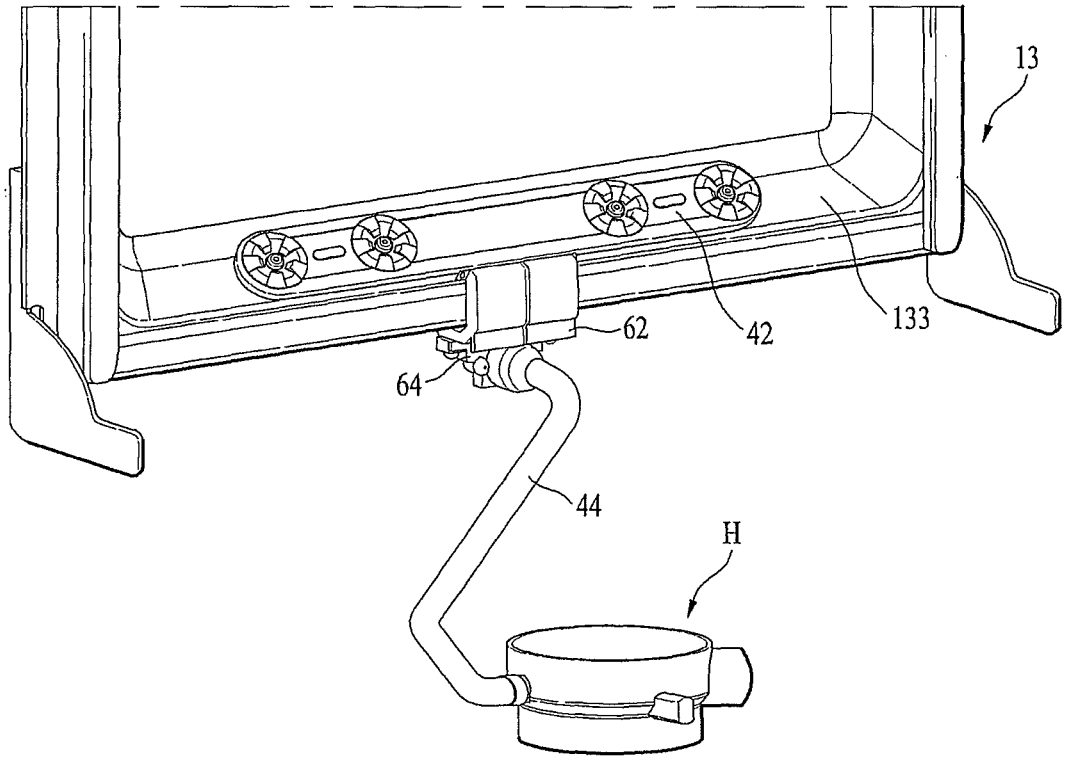
FIG. 2 is a perspective view showing the rear of a door provided in the dishwasher according to the present invention.
Figure 3:
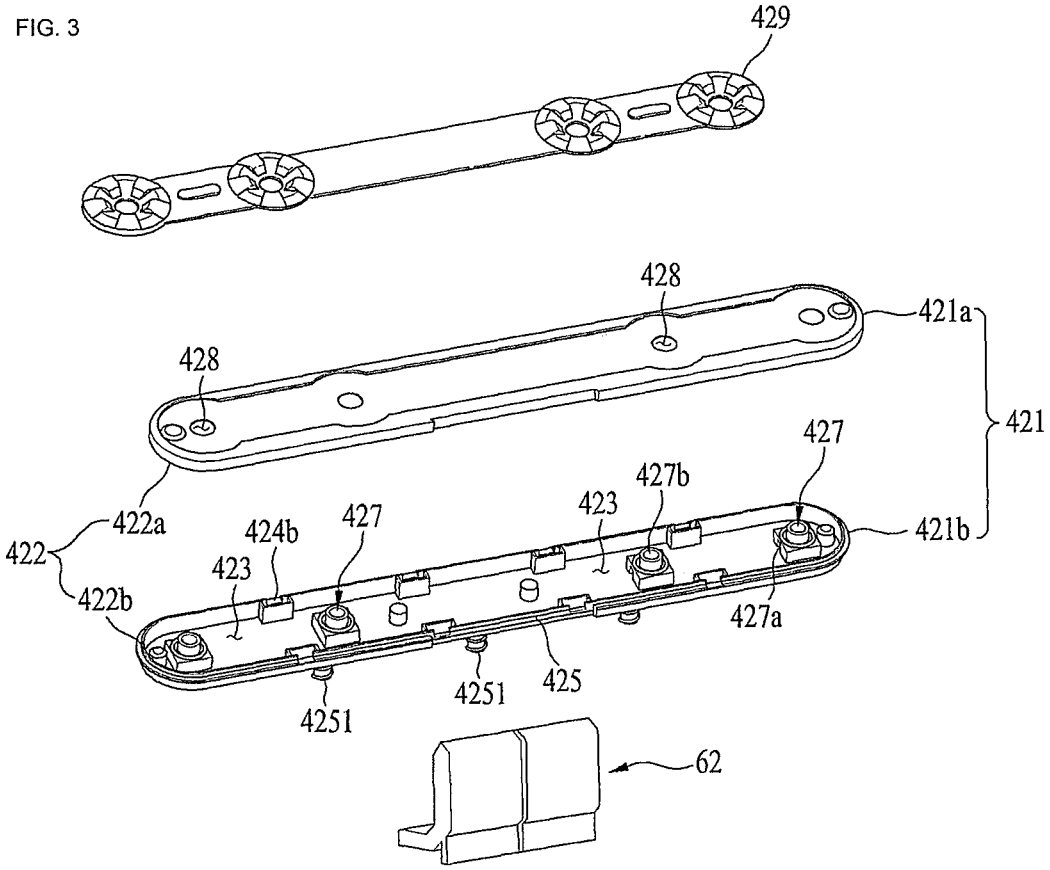
FIG. 3 is an exploded perspective view showing a first steam nozzle and a docking unit provided in the dishwasher according to the present invention.

FIG. 2 is a perspective view showing the rear of the door provided in the dishwasher according to the present invention. FIG. 3 is an exploded perspective view showing a first steam nozzle and a docking unit provided in the dishwasher according to the present invention. FIG. 4 is an exploded perspective view showing the rear panel of the door and the bottom of the tub in the dishwasher according to the present invention.

Hereinafter, a first steam nozzle 42 provided in the dishwasher according to the present invention will be described with reference to FIGS. 2 and 3. The dishwasher 100 according to the present invention may supply steam to the objects in order to improve washing efficiency.

In the conventional dishwasher, steam is sprayed only from the side of the tub. As a result, the steam is intensively sprayed to objects placed in the opposite sides of the rack. That is, the steam is not uniformly sprayed throughout the tub. In addition, the temperature of the dishes is not uniform.

In order to solve the above problems, as shown in FIG. 2, the dishwasher according to the present invention may further include a first steam nozzle 42 provided inside the door 13 for spraying steam to the objects. In this case, steam may be uniformly sprayed to the dishes in the washing space, whereby the steam is uniformly sprayed to the objects.

The "inside of the door 13" means the surface of the door 13 that faces the washing space 21 in the tub 2. In other words, on the assumption that the door 13 includes a front panel 131 defining the external appearance of the dishwasher 100, a rear panel 133 defining the inside of the door, and an inner space 135 defined between the front panel 131 and the rear panel 133, the first steam nozzle 42 may be provided at the rear panel 133 of the door 13.

Meanwhile, the first steam nozzle 42 may be provided at the lower side of the door 13. In this case, it is possible to use the property whereby steam rises. As a result, the steam may be uniformly supplied to the upper part of the washing space as well as the lower part of the washing space. Furthermore, it is possible to maximally increase the temperature of the objects.

In addition, the first steam nozzle 42 may spray steam upward obliquely. That is, the first steam nozzle 42 may spray steam to the objects placed in the upper rack 23 or the lower rack 25. In this case, the first steam nozzle 42 may directly spray steam to the objects.

Referring to FIG. 3, the first steam nozzle 42 may include a first nozzle housing 421 having therein a first steam receiving part 423 for temporarily storing steam, a first receiving part inlet port 425 provided in the first nozzle housing 421 for supplying steam to the first steam receiving part 423, and a plurality of first receiving part outlet ends 427 provided in the first nozzle housing 421 for spraying the steam stored in the first steam receiving part 423 to the objects.

The first nozzle housing 421 may include a first lower nozzle housing 421*b* and a first upper nozzle housing 421*a* coupled to the upper end of the first lower nozzle housing 421*b* for defining the first steam receiving part 423. The first receiving part inlet port 425 is provided in the side of the first nozzle housing 421 and is connected to a docking unit discharge port 627, a description of which will follow, such that steam is supplied to the first nozzle housing 421.

The first receiving part outlet ends 427 are provided in the first lower nozzle housing 421*b*. The first upper nozzle housing 421*a* is provided with first outlet end through holes 428, through which the first receiving part outlet ends 427 extend. Each of the first receiving part outlet ends 427 includes a first inlet port 427*a* communicating with the first steam receiving part and a first outlet port 427*b* provided in one end of the first receiving part outlet end, which is the end through which steam is actually discharged. That is, the first inlet port 427*a* is provided in the first steam receiving part, and the first outlet port 427*b* protrudes outward from the first nozzle housing.

The first nozzle housing 421 includes a first nozzle fastening protrusion 4251 protruding outward so as to be inserted through a first steam nozzle fixing hole 1331 (see FIG. 4) provided in the rear panel 133 of the door 13. After being inserted through the first steam nozzle fixing hole 1331, the first nozzle fastening protrusion 4251 protrudes into the inner space 135 of the door 13. A fixing member 4253, having a screw thread formed in the inner circumferential surface thereof, may be fitted onto the first nozzle fastening protrusion 4251, which has a screw thread corresponding to the screw thread of the fixing member 4253.

The first upper nozzle housing 421*a* and the first lower nozzle housing 421*b* are fastened to each other via a hook. A nozzle gasket (not shown) may be provided between the first upper nozzle housing 421*a* and the first lower nozzle housing 421*b* in order to prevent steam from leaking from the gap between the first upper nozzle housing 421*a* and the first lower nozzle housing 421*b*.

The nozzle gasket (not shown) is made of rubber, and is manufactured by insert injection molding. The nozzle gasket (not shown) seals the gap in the first nozzle housing 421 to prevent the leakage of steam. In addition, the nozzle gasket (not shown) seals the gap between the inside of the door 13 and the first steam nozzle 42 to prevent foreign matter from accumulating between the door and the first steam nozzle 42. The nozzle gasket (not shown) may be configured to cover only the gap in the first nozzle housing 421 and to cover the entire surface of the first lower nozzle housing 421*b*.

The first nozzle housing 421 extends in the leftward and rightward direction of the door. The first receiving part outlet ends 427 are provided in the first nozzle housing 421 so as to supply steam throughout the washing space.

Meanwhile, the first steam nozzle 42 may further include a first nozzle decorative part 429 provided outside the first nozzle housing 421 for improving the aesthetic appearance of the nozzle. Meanwhile, the first steam receiving part 423 may be configured such that the sectional area of the first steam receiving part 423 gradually decreases as the first steam receiving part 423 becomes more distant from the first receiving part inlet port 425. As the first steam receiving part 423 becomes more distant from the first receiving part inlet port 425, the pressure of steam in the first steam receiving part 423 is lowered. As a result, the pressure of the steam discharged from the first receiving part outlet ends 427 may be lowered.

In order to solve this problem, although not shown, the first steam receiving part 423 is configured such that the sectional area of the first steam receiving part 423 gradually decreases as the first steam receiving part 423 becomes more distant from the first receiving part inlet port 425 such that the pressure of steam discharged from the first receiving part outlet ends 427 is uniform.

The first nozzle housing 421 may include a plurality of ribs 422 for coupling the first upper nozzle housing 421*a* and the first lower nozzle housing 421*b* to each other in the sealed state. The ribs 422 include an upper rib 422*a* protruding downward from the first upper nozzle housing and a lower rib 422*b* protruding upward from the first lower nozzle housing. Alternatively, two or more upper ribs 422*a* and two or more lower ribs 422*b* may be provided such that the ribs overlap each other. The ribs 422 prevent steam from leaking from the first steam receiving part 423. Meanwhile, the first nozzle housing 421 may include a hook and a hook hole 424*b* for coupling the first upper nozzle housing 421*a* and the first lower nozzle housing 421*b* to each other.

FIG. 5 is a view showing the state in which the door is open in the dishwasher according to the present invention. FIG. 6 is a side sectional view of FIG. 5. FIG. 7 is a side sectional view showing the state in which the door is closed in the dishwasher according to the present invention. Hereinafter, the structure in which steam is supplied to the first steam nozzle 42 provided in the dishwasher according to the present invention will be described.

In the above description, the first steam nozzle 42 is provided at the door. In the following description, components, such as a docking unit 62, a docking connector 64, and a first steam path 44, which define a path for supplying steam to the first steam nozzle 42 may be applied in the case in which the first steam nozzle 42 is provided in the tub 2, rather than at the door 13. Consequently, it should be noted that the descriptions of the docking unit 62, the docking connector 64, and the first steam path 44 are not limited to the case in which the first steam nozzle 42 is provided at the door 13.

As shown in FIGS. 5 and 6, the dishwasher 100 according to the present invention includes a docking unit (or duct) 62, which is provided at the door 13 and is connected to the first steam nozzle 42 for supplying steam to the first steam nozzle 42 and a docking connector 64, which is provided at the tub 2 and is connected to a steam source for supplying steam to the docking unit 62. Consequently, when the door 13 is opened, the docking unit 62 is disconnected from the docking connector 64.

When the door 13 is closed, the docking unit 62 is connected to the docking connector 64 to define a closed path, along which steam flows. In other words, when the door 13 is opened, the path, along which steam to be supplied to the first steam nozzle 42 flows, is opened, and, when the door 13 is closed, the path, along which steam to be supplied to the first steam nozzle 42 flows, is closed. The reason for this is that it is sufficient for the steam path to remain closed only when the dishwasher is used.

As shown in FIG. 5, the docking unit 62 and the docking connector 64 are disconnected from each other in the tub. In other words, the open point of the path for supplying steam to the first steam nozzle 42 in the state in which the door is open is located in the tub 2. As a result, steam leaks from the open point in the tub, thereby preventing the leakage of steam out of the tub 2.

Referring to FIGS. 6 and 7, the docking unit 62 is fixed to the inside, i.e. the rear panel 133, of the door 13. In this case, the docking unit 62 may be located in a docking unit location part 1333, which is concavely formed in the rear panel 133 of the door 13 (see FIG. 4).

The docking unit 62 communicates with the first steam nozzle 42 to define a steam path. To this end, the docking unit 62 includes a docking unit outlet port 627 connected to the first steam nozzle 42, a docking unit path 623 connected to the docking unit outlet port 627, and a docking unit inlet port 625, which is the other end of the docking unit path 623. In this case, the docking unit inlet port 625 is connected to the docking connector 64 such that steam is supplied to the docking unit inlet port 625.

More specifically, the docking unit 62 includes a first body 621*a* connected to the first steam nozzle 42, a second body 621*b* connected to the first body 621*a* at a predetermined angle, and a docking unit path 623 defined in the first body 621*a* and the second body 621*b*. The docking unit inlet port 625 is connected to the end of the second body 621*b* so as to supply steam to the docking unit path 623.

When the door is opened, as shown in FIG. 6, the first body 621*a* is disposed horizontally, and the second body 621*b* is disposed vertically. When the door is closed, as shown in FIG. 7, the first body 621*a* is disposed vertically, and the second body 621*b* is disposed horizontally. The docking unit 62 is not necessarily configured such that the first body 621*a* and the second body 621*b* are perpendicular to each other. The docking unit 62 may be configured such that the first body 621*a*, which is connected to the first steam nozzle 42, and the second body 621*b*, which is connected to the first body 621*a*, form an acute angle in the forward direction of the dishwasher. Alternatively, the first body 621*a* and the second body 621*b* may be curved so as to be concavely formed in the forward direction of the dishwasher.

The reason that the docking unit 62 is configured so as to be concavely formed in the forward direction of the dishwasher is that the docking unit 62 is prevented from colliding with the front side surface of the tub 2 when the door 13 is opened and closed. Meanwhile, a rotary shaft (or axis) C of the door 13 is provided adjacent to the docking unit inlet port 625 such that the turning radius of the docking unit inlet port 625 is minimized.

As previously described, when the door is opened, the docking unit inlet port 625 is disconnected from the docking connector 64, and when door is closed, the docking unit inlet port 625 is connected to the docking connector 64. If the turning radius of the docking unit inlet port 625 is large, however, the docking unit inlet port 625 may not be aligned with the docking connector 64 due to assembly error or distortion of the door. In order to solve this problem, the rotary shaft C of the door 13 is provided adjacent to the docking unit inlet port 625 such that the turning radius of the docking unit inlet port 625 is minimized when the door 13 is opened.

Meanwhile, as shown in FIG. 5, the dishwasher according to the present invention includes an overhang 629 protruding from the docking unit 62 for preventing the introduction of foreign matter as the result of opening of a connector outlet port 643 of the docking connector 64, a detailed description of which will follow, due to the disconnection of the docking unit 62 from the docking connector 64 when the door 13 is opened.

Even in the case in which the turning radius of the docking unit inlet port 625 is minimized so as to be spaced apart from the connector outlet port 643 of the docking connector 64 by the minimum distance, foreign matter falling from the top of the tub or the rack may be introduced into the connector outlet port 643.

In order to solve this problem, the overhang 629 is provided parallel to the first body 621*a*. In addition, the overhang 629 is provided above the connector outlet port 643. That is, the overhang 629 is provided so as to cover the opening area of the connector outlet port 643.

When the door is closed, as shown in FIG. 7, the overhang 629 is located at the rear of the interconnection of the docking unit 62 and the docking connector 64 (i.e. at the rear of the dishwasher) so as to prevent the wash water in the tub 2 from being introduced between the docking unit 62 and the docking connector 64. That is, the overhang 629 functions as a cover plate.

FIG. 8 is an exploded perspective view showing the docking connector and the first steam path provided in the dishwasher according to the present invention. Hereinafter, the docking connector 64 will be described with reference to FIGS. 6 to 8.

The docking connector 64 includes a connector body 641, a connector path 647 defined in the connector body, a connector outlet port 643 provided at one end of the connector path 647 and connected to the docking unit so as to define a closed path, and a connector inlet port 645 provided at the other end of the connector path 647. The connector body 641 extends through a connector through hole 281 provided in the bottom 28 of the tub 2. A rubber gasket 283 for preventing the leakage of wash water from the tub 2 is provided between the upper surface/lower surface of the bottom of the tub and the connector body 641.

The connector outlet port 643 is provided in the bottom 28 of the tub 2 so as to be connected to the docking unit inlet port 625 when the door is closed. The connector inlet port 645 is provided outside the tub 2, i.e. under the bottom 28 of the tub. The connector inlet port 645 is connected to the steam source via the first steam path 44 such that steam is supplied to the connector inlet port 645.

The steam source may be variously configured. In one example, an additional steam generator (not shown) may be provided under the tub, and the first steam path 44 may be connected to the steam generator (not shown) such that steam is supplied to the first steam nozzle 42. In another example, a sump heater (not shown) may be provided in the sump 3, and the first steam path 44 may be connected to one side of the sump 3 such that steam is supplied to the first steam nozzle 42.

In a further example, as shown in FIG. 8, steam may be supplied using the pump heater 83, provided in the pump 8. The steam generated by the pump heater 83 may be supplied to one end of the first steam path 44, which is connected to the pump 8.

Specifically, since the heater assembly H of the pump 8 is provided in the bottom of the first chamber C1, a predetermined amount of wash water is supplied into the first chamber C1, and then the pump heater 83 may be operated to generate steam. A steam discharge port 843 for discharging the steam, generated in the first chamber C1, out of the first chamber C1 may be further provided. The steam discharge port 843 may be connected to the first steam path 44. The steam generated by the pump 8 is supplied to the first steam nozzle 42 via the first steam path 44. The steam is sprayed into the tub.

FIG. 9 is a view showing a connector gasket in the state in which the door is open in the dishwasher according to the present invention. FIG. 10 is a view showing the connector gasket in the state in which the door is closed in the dishwasher according to the present invention. FIG. 11 is a sectional view showing the connector gasket in the state in which the door is closed in the dishwasher according to the present invention.

Referring to FIG. 5 or 9, the dishwasher according to the present invention further includes a connector gasket 644 provided between the docking unit 62 and the connector outlet port 643 for forming a seal between the docking unit 62 and the connector outlet port 643 when the connector outlet port 643 is connected to the docking unit 62. That is, the connector gasket 644 is provided between the connector outlet port 643 and the docking unit inlet port 625 to prevent the leakage of steam therebetween, to prevent the occurrence of noise when the door is opened and closed, and to serve as a damper for absorbing impact.

The connector gasket 644 may be provided at the upper surface thereof with a cross-shaped incision part 644*a*. In this case, the dishwasher according to the present invention further includes a docking unit protrusion 625*a* protruding from the docking unit inlet port 625 of the docking unit 62. When the door is closed, therefore, the docking unit protrusion 625*a* is inserted through the incision part 644*a* such that the docking unit path 623 and the connector path 647 communicate with each other, whereby steam flows (see FIGS. 10 and 11).

Meanwhile, when the door 13 is opened, the docking unit protrusion 625*a* is separated from the incision part 644*a*, with the result that the shape of the incision part 644*a* returns to the original shape thereof. Even though the incision part 644*a* is formed in the upper surface of the connector gasket 644, therefore, it is possible to prevent wash water falling from the tub or foreign matter falling from the rack from being introduced into the connector path 647. The connector gasket 644 may be made of an elastic material. For example, the connector gasket 644 may be made of rubber.

Figure 14:
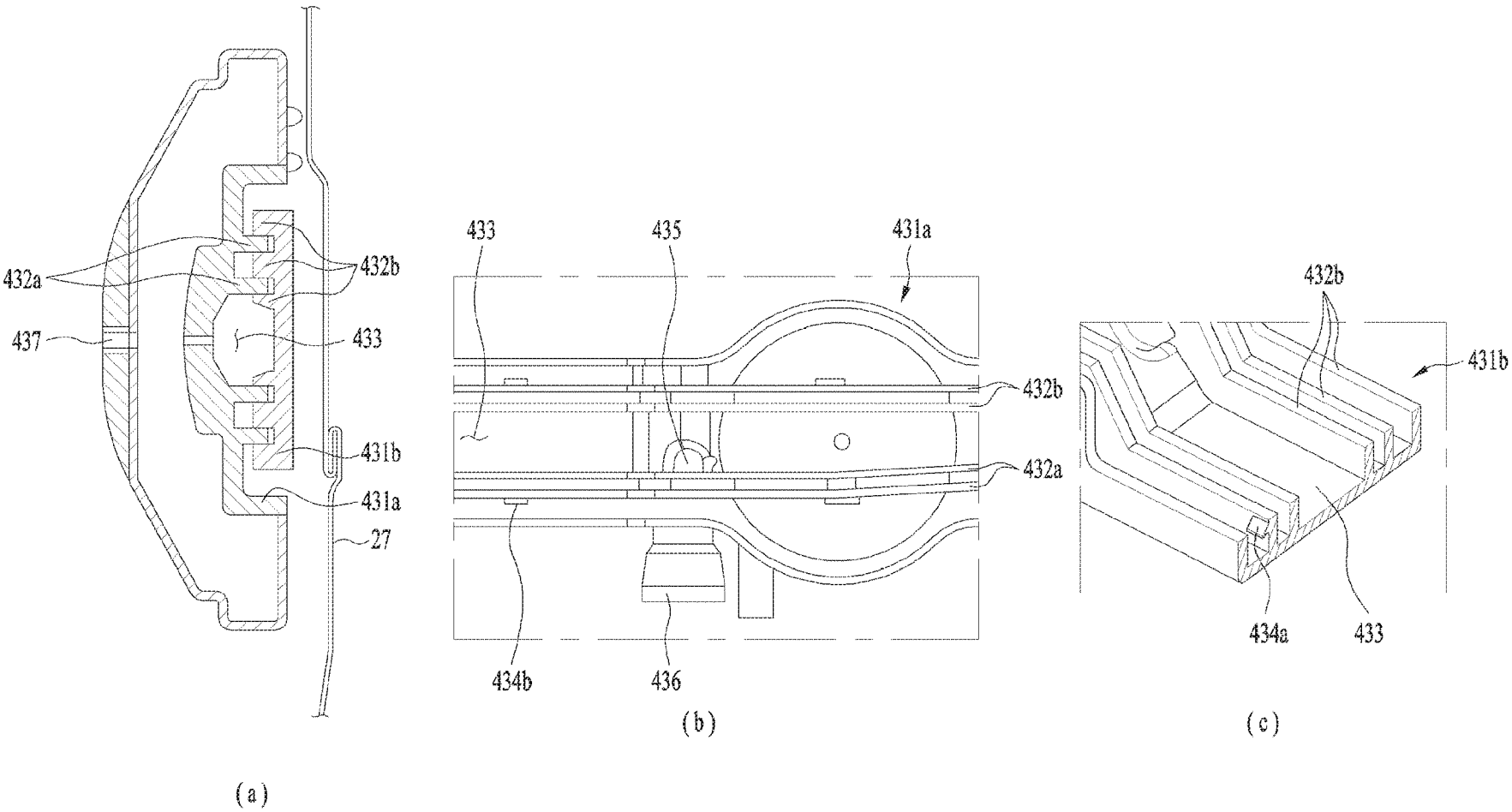
FIG. 14 is a sectional view and an internal perspective view showing the second steam nozzle provided in the dishwasher according to the present invention.

FIG. 12 is a view showing a second steam nozzle provided at the rear of the tub provided in the dishwasher according to the present invention. FIG. 13 is an exploded perspective view showing the second steam nozzle provided in the dishwasher according to the present invention. FIG. 14 is a sectional view and an internal perspective view showing the second steam nozzle provided in the dishwasher according to the present invention. FIG. 15 is a view showing foreign matter blocking ribs provided in the second steam nozzle of the present invention.

Hereinafter, the structure in which steam is sprayed from the rear of the tub will be described. Referring to FIG. 12, the dishwasher according to the present invention may include a second steam nozzle 43 provided at the rear of the tub 2 for spraying steam to the objects and a second steam path 45 for supplying steam to the second steam nozzle 43.

The second steam nozzle 43 may be separably fixed in the first supply path 731. Specifically, the second steam nozzle 43 may be provided at the lower part of the rear 27 of the tub (the lower part of the side of the tub). This is because steam is characterized in that it rises and because it is necessary to supply steam throughout the washing space. In addition, the second steam nozzle 43 may be inclined upward toward the objects such that steam is directly supplied to the objects in order to effectively remove foreign matter from the objects.

Referring to FIG. 13, the second steam nozzle 43 may include a second nozzle housing 431 having therein a second steam receiving part 433 for temporarily storing steam, a second receiving part inlet port 435 provided in the second nozzle housing 431 for supplying steam to the second steam receiving part 433, and a plurality of second receiving part outlet ends 437 provided in the second nozzle housing 431 for spraying the steam stored in the second steam receiving part 433 to the objects, like the first steam nozzle.

The second nozzle housing 431 includes a second lower nozzle housing 431*b*, in which the second receiving part inlet port 435 is provided, and a second upper nozzle housing 431*a* coupled to the upper end of the second lower nozzle housing 431*b* for defining the second steam receiving part 433. The second receiving part outlet ends 437 are provided in the second upper nozzle housing 431*a*.

The second nozzle housing 431 includes a second nozzle insertion part 436 protruding outward and communicating with the second receiving part inlet port 435 for supplying steam to the second steam nozzle 43. The second nozzle insertion part 436 communicates with the second steam path 45 such that steam is supplied to the second nozzle insertion part 436.

Meanwhile, a back pressure prevention unit for preventing external air from being introduced into the pump may be provided between the second steam path 45 and the second nozzle insertion part 436. An example of the back pressure prevention unit may be a check valve 47. A detailed description of the back pressure prevention unit will follow.

As shown in FIG. 14, the second upper nozzle housing 431*a* and the second lower nozzle housing 431*b* are fixed to each other by fastening using a hook 434*a* and a hook fastening part 434*b*. A plurality of steam leakage prevention ribs 432 may be provided in order to prevent steam from leaking out from between the second upper nozzle housing and the second lower nozzle housing.

The steam leakage prevention ribs 432 includes upper steam leakage prevention ribs 432*a* provided in the second upper nozzle housing 431*a* and lower steam leakage prevention ribs 432*b* provided in the second lower nozzle housing 431*b*. For example, in the case in which two upper steam leakage prevention ribs 432*a* are provided in the second upper nozzle housing 431*a*, three lower steam leakage prevention ribs 432*b* are provided in the second lower nozzle housing 431*b*. The upper steam leakage prevention ribs 432*a* are inserted between the lower steam leakage prevention ribs 432*b* in a dual sealing fashion so as to prevent steam from leaking outside.

The second nozzle housing 431 extends in the leftward and rightward direction of the door. The second receiving part outlet ends 437 are provided in the second nozzle housing 431 so as to supply steam throughout the washing space.

The second steam receiving part 433 may be configured such that the sectional area of the second steam receiving part 433 gradually decreases as the second steam receiving part 433 becomes more distant from the second receiving part inlet port 435. As the second steam receiving part 433 becomes more distant from the second receiving part inlet port 435, the pressure of steam in the second steam receiving part 433 is lowered.

As a result, the pressure of steam discharged from the second receiving part outlet ends 437 may be lowered. In order to solve this problem, the second steam receiving part 433 is configured such that the sectional area of the second steam receiving part 433 gradually decreases as the second steam receiving part 433 becomes more distant from the second receiving part inlet port 435 such that the pressure of the steam discharged from the second receiving part outlet ends 437 is uniform.

Meanwhile, the second steam nozzle 43 is spaced apart from the rear 27 of the tub 2 such that foreign matter is prevented from accumulating between the second steam nozzle 43 and the rear 27 of the tub 2. This structure is provided to prevent foreign matter removed from the objects from accumulating between the second steam nozzle 43 and the wall of the tub 2 while falling along the wall of the tub 2.

Furthermore, as shown in FIG. 15, the dishwasher according to the present invention may further include foreign matter blocking ribs 438 for maintaining the distance between the second steam nozzle 43 and the rear 27 of the tub 2 by a predetermined distance or more.

The foreign matter blocking ribs 438 protrude from the rear of the second steam nozzle 43, i.e. the second lower nozzle housing 431*b*. The foreign matter blocking ribs 438 extend in the upward and downward direction to maintain the distance between the second steam nozzle 43 and the tub 2 and to guide wash water therebetween. Consequently, the distance between the second steam nozzle 43 and the rear 27 of the tub 2 is maintained despite vibration of the pump 8 and vibration of the tub 2.

Meanwhile, referring back to FIG. 12, the second steam path 45 is defined in the tub 2. The second steam path 45 extends through the bottom of the tub 2. Specifically, the second steam path 45 is connected to the second nozzle insertion part 436 of the second steam nozzle 43, provided in the tub 2. The second steam path 45 is provided on the bottom of the tub 2, and the other side of the second steam path 45 extends through the bottom 28 of the tub 2.

In this case, a second connection path 46 is provided under the tub 2 such that the second connection path 46 is connected between the second steam path 45 and the steam source. That is, the in-tub section of the path for supplying steam from the steam source to the second steam nozzle 43 is defined as the second steam path 45, and the out-of-tub section is defined as the second connection path 46. As previously described, one selected from among the steam generator, the sump heater, which is provided in the sump, and the pump heater, which is provided in the pump, may be used as the steam source.

In the case in which the pump heater 83, provided in the pump 8, is used as the steam source, the second connection path 46 is connected to the steam discharge port 843, which is provided in the first chamber C1 of the pump 8. Alternatively, the second connection path 46 may diverge from the first steam path 44. The divergent part may be provided with a switch valve (not shown) for adjusting the amount of steam that is supplied to the first steam path 44 or the second connection path 46 or for opening and closing the first steam path 44 or the second connection path 46.

The second connection path 46 is connected to the pump 8 and to the second steam path 45, which extends through the bottom 28 of the tub. In this case, as the length of the second connection path 46 is increased, the steam performance is lowered as the result of condensation due to the difference in temperature between the second connection path 46 and external air. In order to solve this problem, it is necessary to minimize the length of the second connection path 46. That is, the length of the second steam path 45 may be greater than the length of the second connection path 46.

FIG. 16 is an exploded perspective view showing a back pressure prevention unit provided in the docking connector provided in the dishwasher according to the present invention. FIGS. 17 and 18 are views showing the back pressure prevention unit of the present invention.

The docking connector 64 of the present invention includes a back pressure prevention unit provided in the connector inlet port 645 for preventing the introduction of external air into the first steam path 44. Alternatively, the dishwasher according to the present invention may further include a back pressure prevention unit for preventing the introduction of external air into the sump 3 or the pump 8.

In the case in which the first steam path 44 or the second steam path 45 is connected to the sump 3 or the pump 8, negative pressure is generated in the sump 3 or the pump 8 when the pump 8 is driven to spray wash water into the tub 2. Consequently, external air may be introduced into the sump 3 or the pump 8 through the first steam path 44 or the second steam path 45.

As a result, the pressure of wash water sprayed through the spray arms 711 and 713 may be lowered, or no wash water may be sprayed through the spray arms 711 and 713. In addition, the air may collide with the impeller 85, which is provided in the pump 8, whereby noise may be generated. In order to solve these problems, a check valve 47 for opening the steam path when steam generated by the pump 8 is supplied to the first steam path 44 or the second steam path 45 and for closing the steam path when the pump 8 is driven (i.e. when the impeller is driven) to spray wash water into the tub may be provided as the back pressure prevention unit.

As shown in FIG. 16, the check valve 47 may be provided in the docking connector 64. Although not shown, the check valve 47 may be provided in the second steam nozzle or in the first steam path and/or the second steam path.

The check valve 47, provided in the docking connector 64, may include a first partition 471 having a steam path hole 4711, through which steam is discharged, and a back pressure prevention plate 4713 for opening and closing the steam path hole 4711. The back pressure prevention plate 4713 opens the steam path hole 4711 only when the pressure of the steam discharged through the steam path hole is equal to or greater than a predetermined pressure.

Although not shown, the back pressure prevention plate 4713 becomes thicker toward the center thereof such that, when the back pressure prevention plate 4713 is raised due to the pressure of the steam and then falls, the center of the back pressure prevention plate 4713 is aligned with the center of the steam path hole 4711 due to the back pressure of the pump 8. In the case in which the check valve 47 is provided in the steam nozzle, the first partition 471 may constitute the nozzle housing of the steam nozzle, and the steam path hole 4711 may constitute the receiving part inlet port.

Meanwhile, in the case in which the check valve 47 is provided in the steam path, the first partition 471 may close the first steam path or the second steam path, and steam may be discharged through the steam path hole 4711. In addition, the check valve 47 may further include a prevention plate ring 4715 formed at one side of the back pressure prevention plate 4713 and a prevention plate fixing rib 4712 provided at the first partition 471 such that the prevention plate ring 4715 is fitted onto the prevention plate fixing rib 4712 to limit the movement of the back pressure prevention plate 4713.

Meanwhile, as shown in FIG. 17, the dishwasher according to the present invention may further include separation prevention ribs 4716 provided spaced apart from the outer circumferential surface of the back pressure prevention plate 4713 for preventing the back pressure prevention plate 4713 from being separated in the leftward and rightward direction. Consequently, the leftward or rightward movement of the back pressure prevention plate 4713 is prevented, thereby preventing the steam path hole 4711 from being closed.

The separation prevention rib 4716 may be provided on the first partition 471 or a second partition 473, which is opposite the first partition 471 (see FIG. 15).

In addition, as shown in FIG. 18, the dishwasher according to the present invention may further include stoppers 4731 provided above the back pressure prevention plate 4713 so as to be spaced apart from each other such that the stoppers 4731 collide with the back pressure prevention plate 4713, which is moved by the pressure of steam, to provide restoring force. The stoppers 4731 may be made of an elastic material, such as rubber.

When the back pressure prevention plate 4713 is raised by the pressure of steam, therefore, the back pressure prevention plate 4713 collides with the stoppers 4731. At this time, the elastic force of the stoppers 4731 acts as restoring force. As a result, the back pressure prevention plate returns to the original position thereof.

In addition, the dishwasher according to the present invention may further include a contact prevention rib 4732 formed on the second partition 473, which is opposite the first partition 471, for preventing the back pressure prevention plate 4713 from clinging to the second partition 473 due to a hydroplaning phenomenon. The contact prevention rib 4732 may be provided perpendicularly to a rotary shaft of the back pressure prevention plate 4713.

A plurality of contact prevention ribs 4732 may be arranged at intervals. In addition, the contact prevention ribs 4732 (or grooves between the contact prevention ribs 4732) may be inclined such that, when steam is condensed into water, the water can flow along the incline, thereby preventing the occurrence of a hydroplaning phenomenon on the second partition 473.

MODE FOR INVENTION

Various embodiments have been described in the best mode for carrying out the invention.

INDUSTRIAL APPLICABILITY

The present invention has the effect of providing a dishwasher including a steam path for supplying steam to a steam nozzle provided at a door.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A dishwasher comprising:

a cabinet having an opening;

a tub provided in the cabinet and configured to receive objects to be washed;

a spray arm that sprays wash water on the objects;

a sump that stores wash water;

a pump that supplies the wash water stored in the sump to the spray arm;

a door that opens and closes the opening;

a first steam nozzle provided in the tub and configured to dispense steam within the tub;

a docking duct provided at the door and connected to the first steam nozzle to supply steam to the first steam nozzle; and a docking connector provided at the tub and connected to a steam source to supply steam to the docking duct, wherein when the door is opened, the docking duct is disconnected from the docking connector, and when the door is closed, the docking duct is connected to the docking connector to define a closed path along which steam flows.

2. The dishwasher according to claim 1, wherein a position where the docking duct and the docking connector are connected to or disconnected from each other is located in the tub.

3. The dishwasher according to claim 1, wherein the docking connector includes:

a connector body;

a connector path defined in the connector body, the connector path constituting a path for steam;

a connector outlet port provided at a first end of the connector path and connected to the docking duct to define a closed path; and a connector inlet port provided at a second end of the connector path.

4. The dishwasher according to claim 3, wherein the connector inlet port is provided outside the tub.

5. The dishwasher according to claim 3, further including:

a first steam path connected between the connector inlet port and the steam source, wherein the steam source includes one selected from among a generator, a sump heater provided in the sump, and a pump heater provided in the pump.

6. The dishwasher according to claim 3, wherein the connector outlet port is provided at a bottom of the tub.

7. The dishwasher according to claim 1, wherein the first steam nozzle is provided at an inside of the door.

8. The dishwasher according to claim 7, wherein the first steam nozzle and the docking duct are fixed to the door and communicate with each other to define a steam path.

9. The dishwasher according to claim 7, wherein the docking duct includes:

a first body having a first end connected to the first steam nozzle;

a second body connected to a second end of the first body at a predetermined angle; and a path defined in the first body and the second body, and wherein the second body includes a docking duct inlet port connected to the docking connector to supply steam to the path.

10. The dishwasher according to claim 9, wherein when the door is closed, the docking duct inlet port is connected to the docking connector, and when the door is opened, the docking duct inlet port is disconnected from the docking connector.

11. The dishwasher according to claim 9, wherein a rotary axis of the door is provided adjacent to one side of the docking duct inlet port.

12. The dishwasher according to claim 9, further including an overhang protruding from the docking duct configured to hang over a connector outlet port of the docking connector to prevent foreign matter from being introduced into the docking connector when the door is opened and the docking duct inlet port is disconnected from the connector outlet port.

13. The dishwasher according to claim 12, wherein the overhang is provided parallel to the first body, and is provided above the connector outlet port when the door is opened.

* * * * *